US006466139B1

(12) United States Patent
Schmidt

(10) Patent No.: US 6,466,139 B1
(45) Date of Patent: Oct. 15, 2002

(54) INFORMATION SYSTEM FOR ROAD TRAFFIC

(75) Inventor: Johan Richard Schmidt, Leiden (NL)

(73) Assignee: Koninklijke KPN N.V. (NL)

( * ) Notice: Subject to any disclaimer, the term of this patent is extended or adjusted under 35 U.S.C. 154(b) by 0 days.

(21) Appl. No.: 09/581,195

(22) PCT Filed: Nov. 24, 1998

(86) PCT No.: PCT/EP98/08555

§ 371 (c)(1),
(2), (4) Date: Jul. 5, 2000

(87) PCT Pub. No.: WO99/35629

PCT Pub. Date: Jul. 15, 1999

(30) Foreign Application Priority Data

Dec. 30, 1997 (NL) ..... 1007931

(51) Int. Cl.[7] ..... G08G 1/09

(52) U.S. Cl. ..... 340/905; 340/995; 340/901; 340/907; 340/539

(58) Field of Search ..... 340/905, 901, 340/991, 993, 995, 907, 916, 539

(56) References Cited

U.S. PATENT DOCUMENTS 6,097,313 A * 8/2000 Takahashi et al. ..... 340/905

6,317,058 B1 * 11/2001 Lemelson et al. ..... 340/910

* cited by examiner

*Primary Examiner*—Daryl Pope

(74) *Attorney, Agent, or Firm*—Michaelson & Wallace; Peter L. Michaelson; Janet M. Skafar

(57) ABSTRACT

Information system for a traffic network (1). Information of importance to travellers is transmitted by a transmitter system (3) to data receivers (pagers) in vehicles (2) making use of the traffic network. The traffic network is broken down into information regions (6). The transmitter system transmits information modules (5) which each relate to an information region and which are characterised by a region-identification code (ID1, ID2 etc.). The information system comprises means for transmitting, upon entry by a vehicle of an information region, to the data receiver in said vehicle the region-identification code of said region, the data receiver setting itself using said region-identification code for receiving information characterised by said region-information code, transmitted by the transmitter system. The region-identification code in the data receiver may be set using regional or local beacon transmitters (4) which transmit one or two region-identification codes.

22 Claims, 4 Drawing Sheets

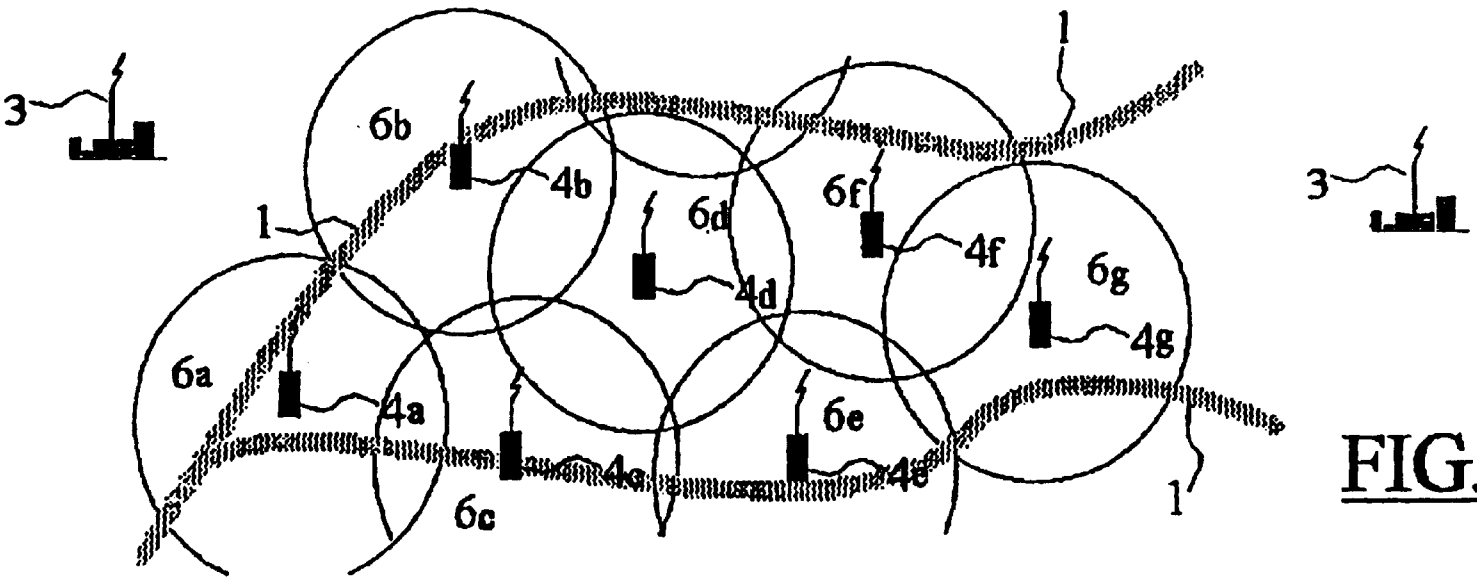
FIG. 3
| ID1 | data1 | ID2 | data2 | ID3 | data3 | ID |
|---|---|---|---|---|---|---|
FIG. 4
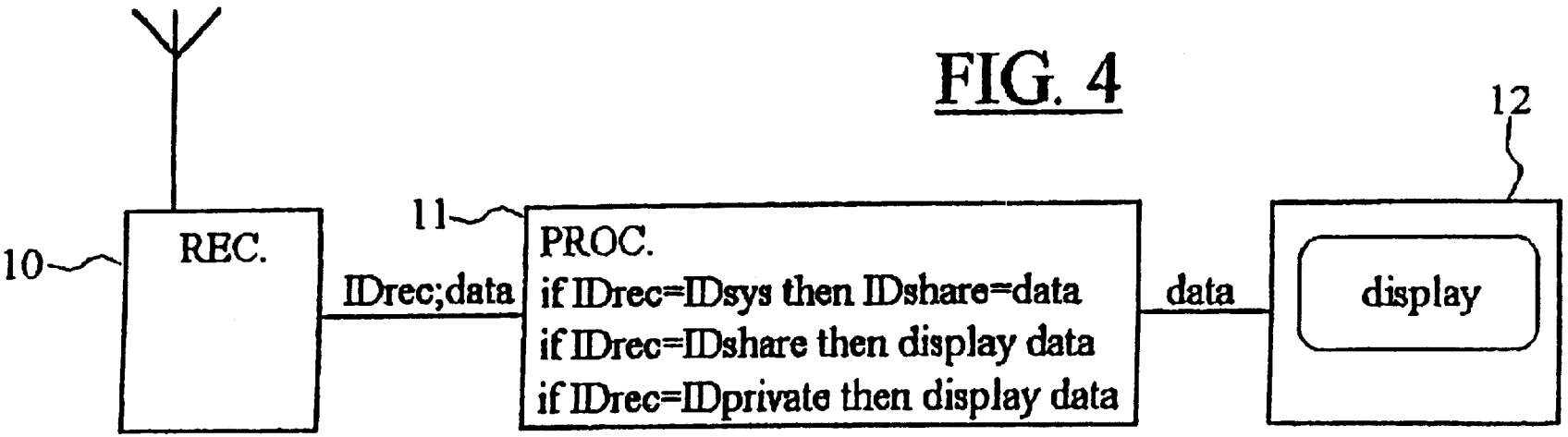

INFORMATION SYSTEM FOR ROAD TRAFFIC

BACKGROUND OF THE INVENTION

The invention relates to an information system for a traffic network, information of interest for travellers being transmitted, by a transmitter system, to data receivers in vehicles making use of the traffic network.

Such a system is disclosed in WO-90/05969, in which the traffic intensity of road sections is measured using infrared detectors and said information, after having been processed, is transmitted to pagers located in vehicles. On said pagers, the traffic intensity of the region is then shown using a graphic display on which the regional road network is shown, as well as the traffic intensity on the various roads. Although the known system gives an impetus to informing road users, the system does not extend beyond a specific region. Although the "region" may of course be chosen large, the consequence then is that the information becomes less specific for each road user.

SUMMARY OF THE INVENTION

The invention provides for a system as indicated hereinabove in which, however, the information may be transmitted more specifically to each road user, while the system is still usable over a large area (national, European).

The present invention represents a system with which said regional distribution of information may be carried out in such a way that for each user the relevant information travels along with him, as it were. For this purpose, the invention provides for means by which the pager used by the traveller for (inter alia) receiving traffic information, is automatically switched from one to the other "information region". The traffic network according to the invention is broken down into information regions having a regional (pager) identification code (RIC) each, and means to provide pagers (in a vehicle), upon entry into a new region, with the RIC in force for said new region. In doing so, of course, use must be made of (modern) pagers which are suitable for setting the RIC by an external code signal. Said type of pager is capable of receiving and displaying messages which are addressed to the (an) individual pager ID [=identifier], but also messages which are addressed to a collective ID, as a result of which one and the same message may be simultaneously passed along to various pagers. Pagers with which said collective ID is capable of being set from the outside may be used in the system according to the invention. The collective ID is preferably set using beacon transmitters.

EXEMPLARY EMBODIMENT

Figure 1:
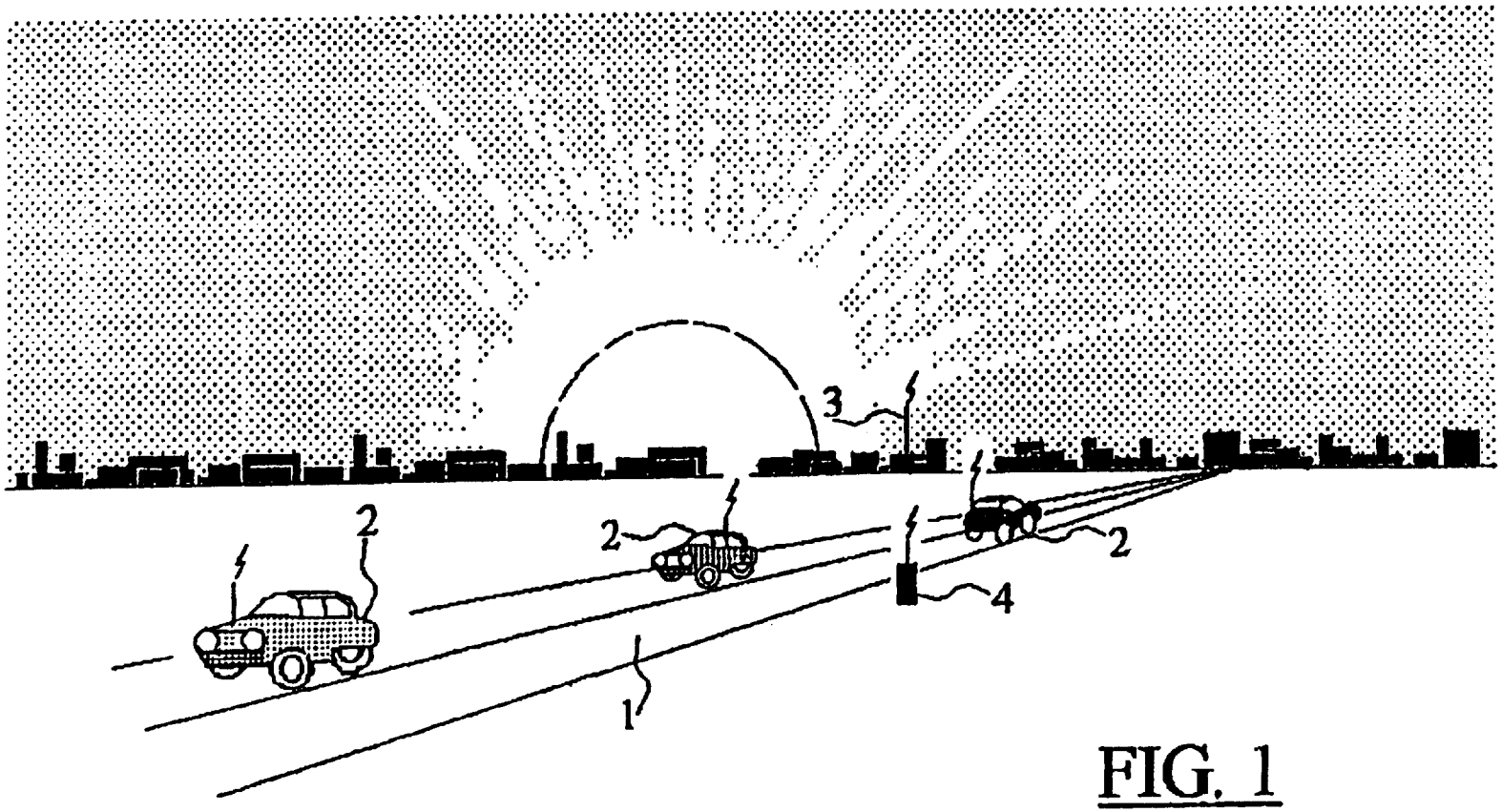

FIG. 1 schematically shows an exemplary embodiment of the invention. Along a motorway 1 there are driving cars 2, provided with pagers, of which only the antennae are visible in the drawing. Information may be transmitted to the pagers by way of a transmitter system 3 (of which one transmitter is drawn).

The pagers each have an individual ID code to which only said one pager responds, but also at least one ID code—a collective ID code—which is not unique and to which, therefore, various pagers may respond. Pagers which are set for receiving such a collective code may—after they have detected said collective ID code—receive a subsequent message and show it on a display. In addition, modern pagers have the option of receiving, by way of a special "system channel" which may be accessed using a special ID code, one or more other (collective) ID codes. There are also pagers with which ID codes nay be set by way of a separate system channel, bypassing the information receiver and making use, e.g., of "RF tagging" [RF=radio-frequency] techniques, transponders etc. The invention makes use of this type of modern pager. In order to enable motorists by way of their pagers to receive information which is relevant to the road section on which they are driving, there are installed local beacon transmitters 4 along the roads. Said beacon transmitters 4 (of which only one has been drawn, but of which there are a great number throughout the entire road network) by way of the system channel transmit to the pagers of passing motorists the ID code which is used for the distribution of information along the road section in the vicinity of said beacon transmitter 4. The beacon transmitters 4 themselves may work in standalone mode and need not themselves be connected to an information network: they need only transmit one or two codes—the ID code which is in force for the road section where the beacon transmitter is located and possibly the ID code of the system channel. The beacon transmitters may be fed by the public power grid or using solar cells.

Figure 5:
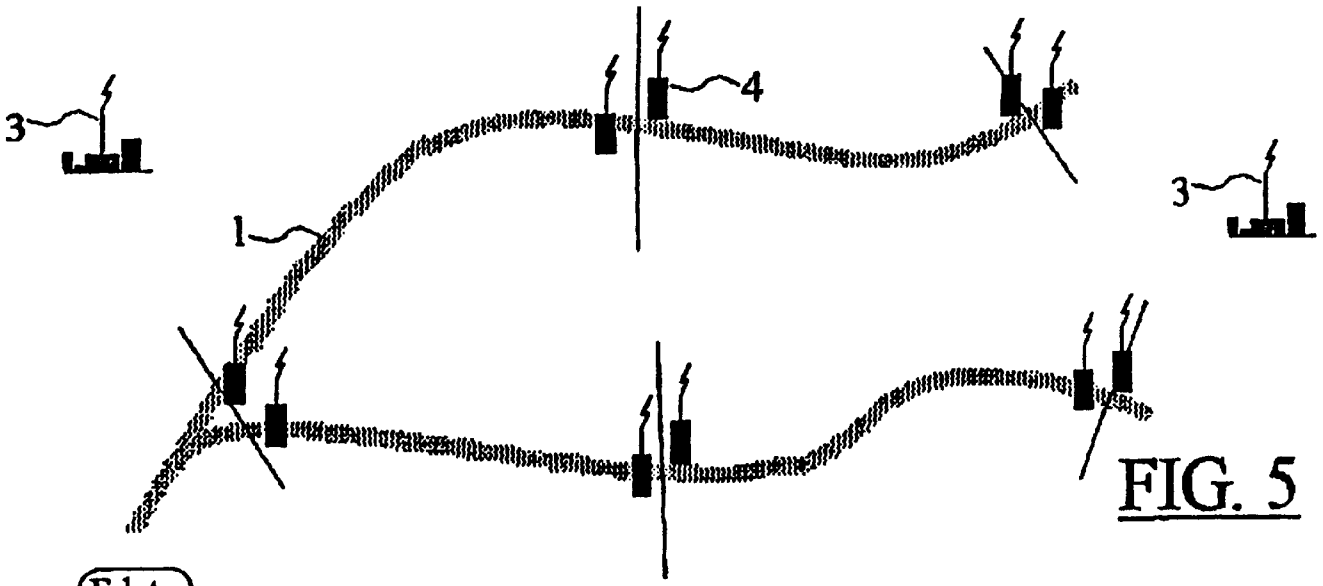
Figure 7:
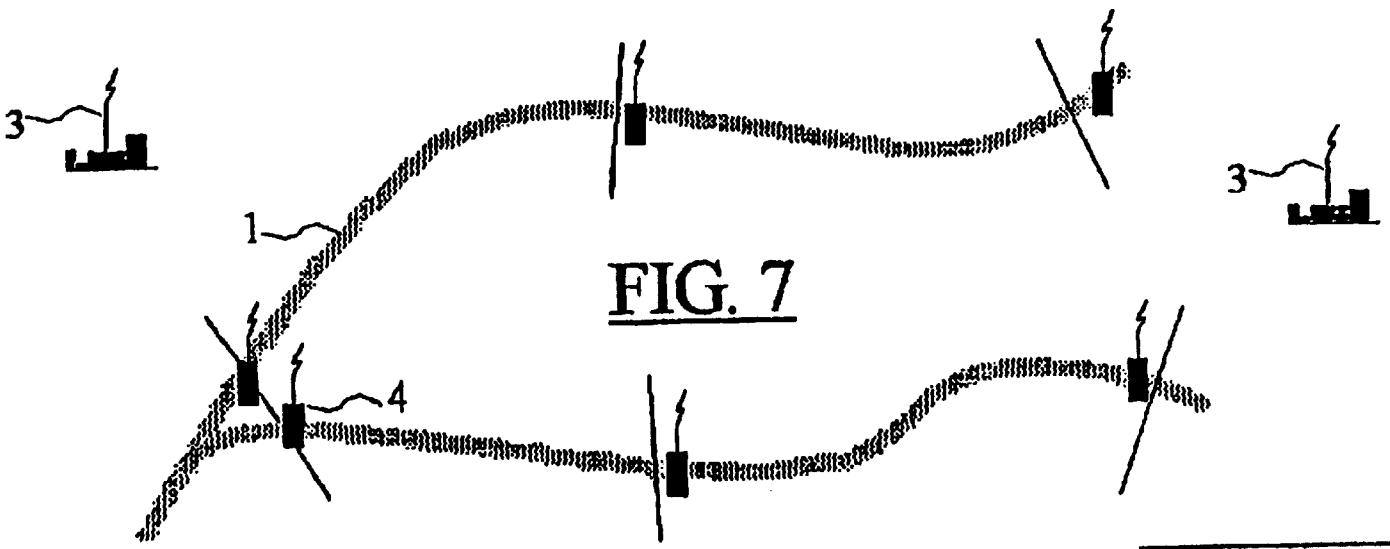
Figure 8:
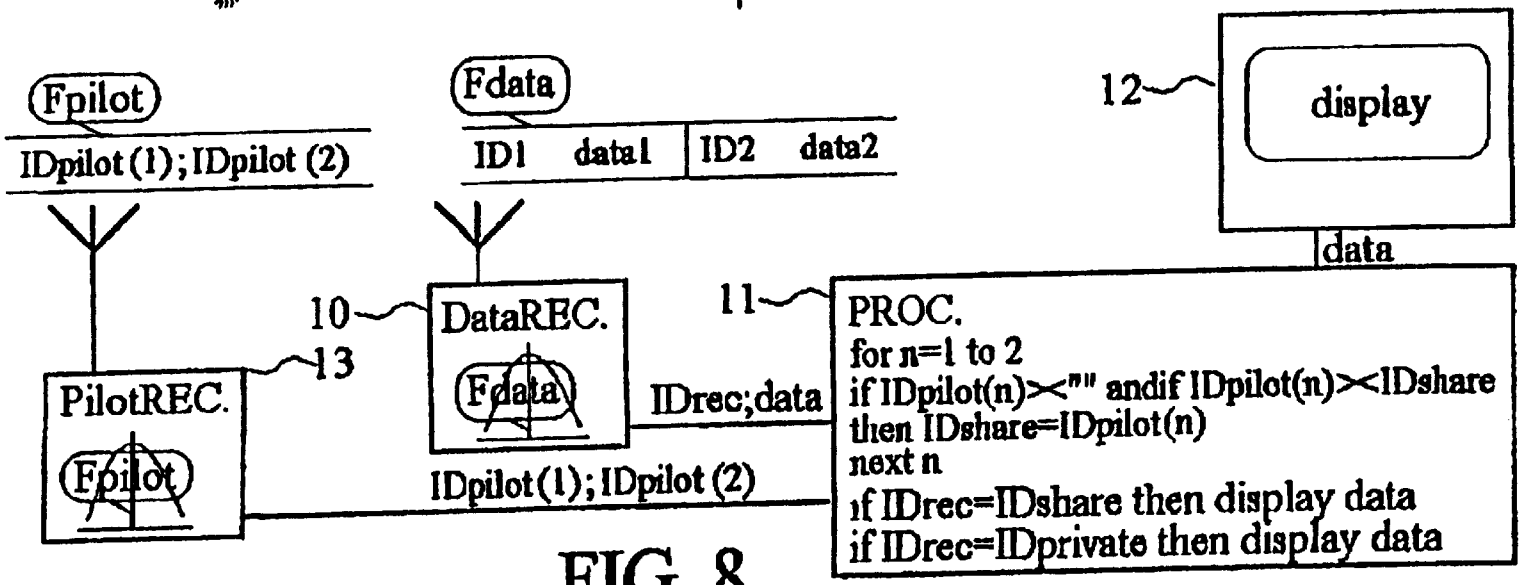

For the system of beacon transmitters, there are several options. The area to which a beacon transmitter relates is entirely covered by said beacon transmitter; the beacon transmitter is located in the middle of the region. All pagers in the region receive the ID code for said region from the beacon transmitter. Said option is illustrated in FIG. 3. Another option is that each beacon transmitter has only a very limited power and is located on the boundary of the region. This is illustrated in FIGS. 5 and 7 which, together with FIGS. 6 and 8, will be discussed in more detail.

The information proper is transmitted by the transmitters 3. Of such transmitters 3, too, there are various, though much fewer than the number of beacon transmitters 4. The transmitters 3 therefore transmit information relating to the various road sections by way of various "information channels", each channel having its own ID code; therefore, there is a coupling between the road-section-bound ID code and the road-section-bound information.

Suppose, a motorist passes beacon transmitter 4. Said transmitter transmits the ID code of the system channel and the ID code in force for said beacon transmitter and for the road section where it is located. After the pager of the beacon transmitter receives the ID code of the system channel, it receives the ID code associated with the road section and sets itself to receiving information by way of said ID code. As soon as the transmitter 3, therefore, transmits information using said road-section ID, the pager passes said information on to the motorist. The pager ignores the information transmitted by the transmitter 3 relating to other road sections as, after all, said information is transmitted by way of channels having other ID codes relevant to other road sections.

Figure 2:
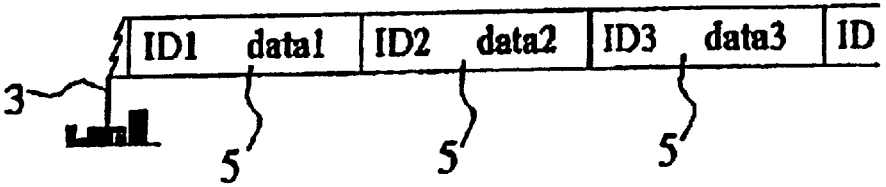

As soon as the motorist passes a subsequent beacon transmitter, the pager again detects the system-channel ID and a new ID code. The pager then sets itself to receiving the channel associated with said ID code, as a result of which the motorist receives, from the transmitter(s) 7, the information which is relevant to the road section on which he is then driving. FIG. 2 illustrates the transmission, by a transmitter 3 of the information-transmitter system, of a series of information modules 5. Each of these comprises a header having an identification code (ID1, ID2, ID3 etc.) and a data field (data1, data2, data3 etc.). The data comprises information on various information regions, as indicated in FIG. 3 by 6*a*, 6*b*, 6*c* etc. Apart from the information regions 6, FIG.

3 also shows the course of several motorways 1. The information relating to the traffic situation on the road sections intersecting with the information regions is transmitted by the transmitter system 3. In order to achieve that the pagers (data receivers) in the cars pass on only the information which is relevant to the region where the car is located, the data receiver is "tuned" to messages preceded by an ID code (ID1 or ID2 or ID3 etc.) which is in force for said region. For example, in the transmitter system (or in the information centre which makes use of the transmitter system) it is determined that messages which are relevant to the region 6*a* are preceded by ID1, messages for region 6*b* by ID2, messages for 6*c* by ID3 etc. The data receivers in passing cars are set, using the beacon transmitters 4*a* . . . *g*, to the transmission of only those messages which are preceded by the ID code of the region of which the beacon transmitter is the centre. Thus, beacon transmitter 4*a* sets the pagers of cars entering the region 6*a* to receiving messages which are preceded by ID1. As soon as a car enters region 6*b* and its pager comes within the sphere of influence of beacon transmitter 4*b* (i.e., when the field intensity of the signal received from 4*b* is greater than the one from 4*a*), the pager is switched over from receiving messages having ID1/data1 to receiving messages having ID2/data2.

It should be noted that the beacon transmitters 6 may work in standalone mode. In the option shown in FIG. 3, where the beacon transmitters are the centre of a region, the transmitting power must be relatively large. In addition, it must be prevented, by using a correct frequency allocation, that there takes place reciprocal interference, or interference with other systems (e.g., GSM). It is possible, though, in this option to combine the beacon transmitters with, e.g., GSM base stations.

It should also be noted that, in the event of using one of the normal pager channels as system channel, it must be seen to that the (standalone) beacon transmitters transmit the ID codes in synchronised mode. For this purpose, the beacon transmitter should be provided with a receiver which, on the basis of the information packets transmitted by the transmitters 3, synchronises the beacon transmitter therewith.

FIG. 4 schematically shows a pager which may be used in the above system. The pager, which is located in a car 2, receives various ID codes together with associated data (IDrec;data) from the transmitter 3 and compares it to the ID codes stored in the pager: IDsys—the ID code of the channel with which, in the pager, ID codes may be set, as a result of which the pager is activated; IDshared—a collective ID code as a result of which the pager is activated (there may be more of such codes: IDshared1, IDshared2 etc.); IDprivate—an individual ID code as a result of which the pager is activated (of these, too, there may be more: IDprivate1, IDprivate2 etc.).

The ID codes and data received are normally received from the transmitter(s) 3. In the system according to the invention, however, the pager in the cars 2 also receives an ID code and "data" from the beacon transmitter 4. The IDsys code is transmitted by said beacon transmitter(s) 4, having as "data" the value of the ID code which is required for receiving data relating to the road segment in the vicinity of the beacon transmitter. As soon as a car arrives in the vicinity of the beacon transmitter 4, the pager therefore receives IDsys as access code and, in the data field, the value for the collective (shared) ID code (IDshared) with which the pager may be activated later for receiving data relating to the road section for which the beacon transmitter is responsible. Said road-section-specific data, incidentally, is transmitted by the transmitter 3 and originates from, e.g., a national traffic centre. The local circumstances on the various road sections are monitored there and transmitted by road-section-specific IDshared codes, so that all road users driving on the same road section, in so far as they are equipped with a pager as described here, be provided with information (data) relating to said road section.

The ID codes and data received, as illustrated in FIG. 4, are received by a receiver 10 and processed in a control module 11. If the control module detects that the ID code received (IDrec) is equal to the system ID code (IDsys)—whose value is programmed into the control module 11—the associated data value is interpreted as new ID code (IDshared) on which the pager may receive relevant road-section information ("If IDrec-IDsys then IDshare-data"). If (subsequently) an ID code received is equal to either said IDshared code or the (programmed, unique) IDprivate code, the associated data is passed on to a display module 12, on which the data is displayed in (e.g.) alphanumeric form: "if IDrec=IDshare then display data (or) if IDrec=IDprivate then display data".

Figure 6:
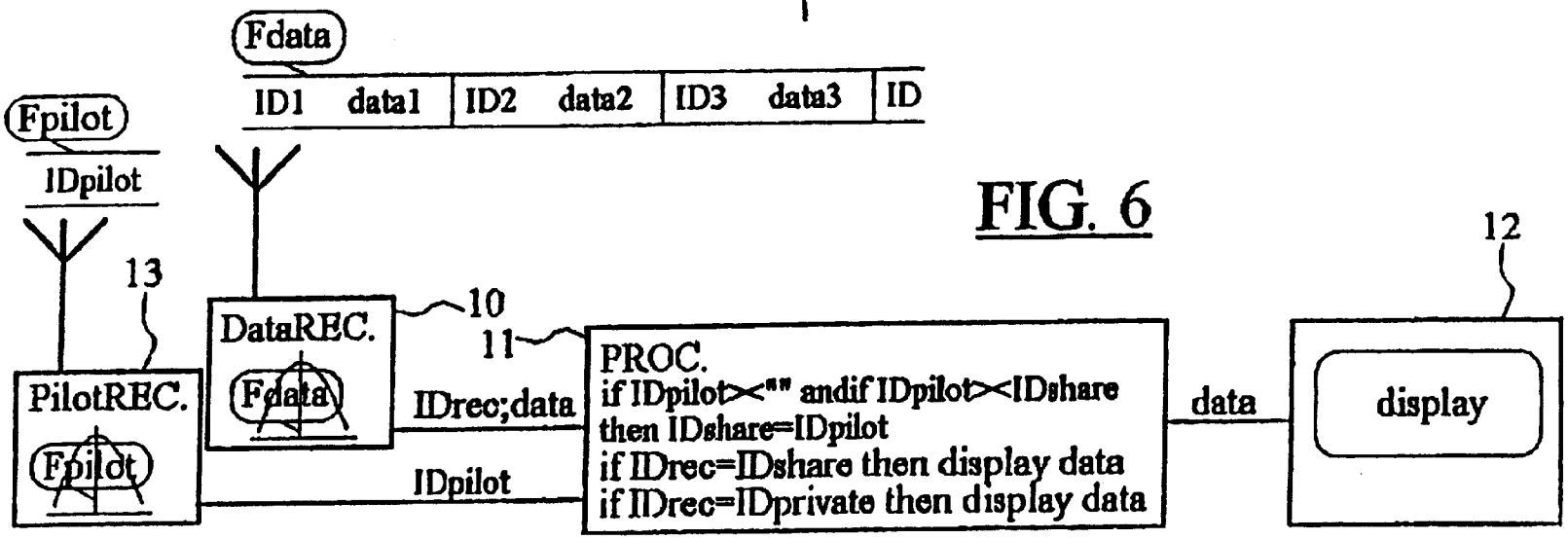

FIGS. 5 and 6 show a preferred option of the invention, in which use is made of beacon transmitters having limited power. In this event, the beacon transmitters are located on the edges of the information region. The pager in a passing car receives the ID code, in passing, to which the pager must be set for receiving information (from transmitters 3) which is relevant to the region (road section) which is entered. In this option, use is preferably made of pagers which, using a separate transmitter 13, receive signals at another frequency (Fpilot) than the one of the carrier wave (Fdata) to which the transmitters 3 transmit their information (data). Due to the low range of the beacon transmitters 4, they may all make use of the same frequency without chancing interference, even with other cordless systems. Each beacon transmitter transmits an ID code (IDpilot) which is equal to the ID code used by the information transmitters 3 for transmitting data which is relevant to the region after the beacon transmitter, the region therefore which is entered by the passing car. As soon as, in the event of passing a beacon transmitter, the control unit 11 receives an IDpilot which is not equal to the ID code (IDshare) to which the pager was hitherto set, the control unit 11 sets the IDshare value in conformity with said received ID code (IDpilot): "if IDpilot><"" andif IDpilot><IDshare then IDshare=IDpilot". As may be seen from FIG. 5, in the event of transition from each region there always are two beacon transmitters, namely, one for one direction of the traffic (from region A to region B) and one for the other direction (from region B to region A); after all, for motorists who enter B the pager must be set, by way of the one beacon transmitter, to the ID code of region B, while the pagers of motorists who enter region A are set, using the other beacon transmitter, to region A. The range and the position of beacon transmitters must therefore be such that they can only affect the pagers in one direction of the traffic. An alternative is offered by the system shown in FIGS. 7 and 8.

In FIG. 7, at each transition between two adjacent regions or road sections, there is located only one beacon, transmitter 4. Each beacon transmitter transmits not one but two ID codes at the beacon frequency Fpilot: IDpilot(1), equal to the ID code for the one region, and IDpilot(2), equal to the ID code for the other, adjacent region. Upon receipt of said two ID codes, the control unit investigates whether either IDpilot (1) or IDpilot(2) is not equal to the ID code to which the pager had already been set. If in two adjacent regions A and B there are in force ID codes IDA and IDB, the beacon transmitter at the partition of said regions transmits IDpilot (1)=IDA and IDpilot(2)=IDB. The pager of a vehicle driving in region A is set to IDshare=IDA. Upon passing the region boundary, the control unit 11 detects that IDpilot(2)><IDA and subsequently sets the pager to IDshare=IDpilot(2)=IDB: "for n=1 to 2: if IDpilot(n)><"" andif IDpilot(n)><IDshare then IDshare=IDpilot(n): next n".

The advantage of said option is that the range of the beacon transmitters is not critical, i.e., there need not be taken care that the beacon transmitters be only received by pagers in one direction. On the contrary, in the present option, pagers must receive the beacon-transmitter signal in both directions. This in its turn may be a drawback in view of the energy supply to the beacon transmitters. It would seem to be a greater drawback, however, that there may be derived no initial ID code from the beacon transmitters, so that an initial ID code, e.g., will have to be entered manually.

What is claimed is:

1. An information system for a traffic network, information of interest to travelers being transmitted by at least one information-transmitter to data receivers in vehicles making use of the traffic network, the traffic network being broken down into information regions, said at least one information-transmitter transmitting information modules which each relate to an information region, at least one information module being associated with a region-identification code, the information system comprising:

a beacon transmitter, in the event of a vehicle entering an information region, transmitting to the data receiver in said vehicle a particular region-identification code associated with said information region, the data receiver setting itself, using said particular region-identification code from said beacon transmitter, to receiving information modules associated with said particular region-identification code that are transmitted by said at least one information-transmitter.

2. The information system according to claim 1, wherein the beacon transmitter transmits the particular region-identification code to the data receivers of vehicles within the transmission range of said beacon transmitter, the data receivers setting themselves to receive information modules transmitted by said at least one information-transmitter, which information modules are associated with the particular region-identification code transmitted by the beacon transmitter.

3. The information system according to claim 1, wherein the beacon transmitter transmits the particular region-identification code to the data receivers of vehicles passing the beacon transmitter, whereupon the data receiver sets itself to receive information modules transmitted by the at least one information-transmitter, which information modules are associated with the particular region-identification code transmitted by the beacon transmitter.

4. The information system according to claim 2, wherein the region-identification code is transmitted by the beacon transmitter by way of the same medium (Fdata) as the one with which the said at least one information-transmitter transmits the information modules.

5. The information system according to claim 2, wherein the region-identification code is transmitted by the beacon transmitter by way of another medium (Fpilot) than the medium (Fdata) by way of which the said at least one information-transmitter transmits the information modules.

6. The information system according to claim 3, wherein each beacon transmitter transmits only the particular region-identification code of the region which is entered by passing vehicles, further comprising:

a control unit setting the data receiver in such a vehicle in conformity with the particular region-identification code received from the beacon transmitter.

7. The information system according to claim 3, wherein each beacon transmitter transmits the particular region-identification codes of both adjacent regions comprising the region just left and the region entered, further comprising:

a control unit setting the data receiver of a passing vehicle in conformity with the value of the particular region-identification code, which is not equal to the region-identification-code setting of said data receiver.

8. The information system according to claim 3, the particular region-identification code being transmitted by the beacon transmitter by way of the same medium (Fdata) as the one with which the said at least one information transmitter transmits the information modules.

9. An information system for a traffic network having information regions, comprising:

at least one information-transmitter that transmits modules comprising information of interest to travelers, each module being associated with an information region and being associated with a region-identification code;

a data receiver in a vehicle making use of the traffic network; and at least one beacon transmitter that transmits a particular region-identification code of one of said information regions when a vehicle enters that information region to the data receiver in said vehicle, wherein the data receiver sets itself, using said particular region-identification code, to receiving modules associated with said particular region-identification code from said at least one information-transmitter.

10. The information system according to claim 9, wherein the beacon transmitter transmits the particular region-identification code to data receivers of vehicles within the transmission range of said beacon, and the data receiver receives modules transmitted by said at least one information-transmitter, the modules being associated with the particular region-identification code transmitted by the beacon transmitter.

11. The information system according to claim 9, wherein the beacon transmitter transmits the region-identification code to the data receiver when the vehicle passes the beacon transmitter, and the data receiver sets itself to listen to modules transmitted by the at least one information-transmitter which are associated with the particular region-identification code transmitted by the beacon.

12. The information system according to claim 10, wherein the particular region-identification code is transmitted by the beacon transmitter by way of the same medium as the said at least one information-transmitter that transmits the modules.

13. The information system according to claim 10, wherein the beacon transmitter transmits the particular region-identification code by way of another medium different from the medium used by said at least one information-transmitter that transmits the modules.

14. The information system according to claim 11, wherein each beacon transmitter transmits only the particular region-identification code of the information region that is entered by passing vehicles, further comprising:

a control unit to set the data receiver in such a vehicle in conformity with the particular region-identification code received from the beacon transmitter.

15. The information system according to claim 11, wherein each beacon transmitter transmits the particular region-identification codes of at least two adjacent regions, further comprising:

a control unit to set the data receiver of a passing vehicle in conformity with the value of the particular identification code, which is not equal to the region-identification code setting of said data receiver.

16. The information system according to claim 11, the region-identification code being transmitted by the beacon transmitter by way of the same medium as said at least one information-transmitter that transmits the modules.

17. The information system of claim 1 wherein the beacon transmitter is located terrestrially.

18. The information system of claim 9 wherein a particular region-identification code is set by a transmission from one beacon transmitter.

19. The information system of claim 9 wherein each beacon transmitter transmits one region-identification code.

20. The information system of claim 9 wherein the at least one beacon transmitter is located terrestrially.

21. The information system of claim 9 wherein a particular region-identification code is set by a transmission from one beacon transmitter.

22. The information system of claim 9 wherein each beacon transmitter transmits one region-identification code.

* * * * *